US008671488B2

(12) United States Patent
Lee

(10) Patent No.: US 8,671,488 B2
(45) Date of Patent: Mar. 18, 2014

(54) STEAM CONTROL DEVICE AND METHOD OF DRUM WASHING MACHINE

(75) Inventor: Ju Dong Lee, Bupyeong-gu (KR)

(73) Assignee: Daewoo Electronics Corporation, Seoul (KR)

( * ) Notice: Subject to any disclaimer, the term of this patent is extended or adjusted under 35 U.S.C. 154(b) by 1053 days.

(21) Appl. No.: 12/699,131

(22) Filed: Feb. 3, 2010

(65) Prior Publication Data

US 2011/0185512 A1 Aug. 4, 2011

(51) Int. Cl.
*D06F 39/04* (2006.01)
*D06F 39/08* (2006.01)

(52) U.S. Cl.
USPC ..... 8/149.3; 8/158

(58) Field of Classification Search
USPC ..... 8/149.1, 149.2, 149.3, 158, 159; 68/12.02, 12.19, 12.21, 207
See application file for complete search history.

(56) References Cited

U.S. PATENT DOCUMENTS

| | | | | |
|---|---|---|---|---|
| 6,823,878 | B1 * | 11/2004 | Gadini | 134/58 D |
| 7,904,982 | B2 * | 3/2011 | Park et al. | 8/158 |
| 7,913,339 | B2 * | 3/2011 | Wong et al. | 8/149.3 |
| 7,980,101 | B2 * | 7/2011 | Son et al. | 68/5 C |
| 2006/0101586 | A1 * | 5/2006 | Park et al. | 8/149 |
| 2006/0191077 | A1 * | 8/2006 | Oh et al. | 8/158 |
| 2009/0007797 | A1 * | 1/2009 | Ando et al. | 99/330 |
| 2009/0293558 | A1 * | 12/2009 | Wong et al. | 68/5 R |

* cited by examiner

*Primary Examiner* — Joseph L Perrin
(74) *Attorney, Agent, or Firm* — Murabito, Hao & Barnes LLP; Andrew D. Fortney

(57) ABSTRACT

A steam control device and method of a washing machine are disclosed. The steam control method includes determining whether an instruction of course washing with steam is input; opening a water supply valve to supply water into a steam generator if the instruction of course washing is input; detecting a temperature of water supplied to the steam generator using a temperature sensor; and checking a water supply time corresponding to the detected water supply temperature and supplying water to the steam generator for the water supply time.

5 Claims, 4 Drawing Sheets

STEAM CONTROL DEVICE AND METHOD OF DRUM WASHING MACHINE

BACKGROUND OF THE INVENTION

1. Field of the Invention

The present invention relates to drum washing machines and, more particularly, to a steam control device and method of a drum washing machine that can control steam generation by adjusting a water supply time depending on the temperature of water supplied to the washing machine.

2. Description of the Related Art

A drum washing machine includes a cabinet having an opening and a tub disposed inside the cabinet to receive wash water. Further, the drum washing machine includes a drum rotatably mounted inside the tub, a drive motor rotating the drum, a water supply valve supplying wash water into the tub, and a detergent case connected to the water supply valve and receiving detergent. Further, the drum washing machine includes a water discharge unit extending from the tub to an outside of the cabinet, a heater provided to a lower side of the tub to heat wash water, and a steam generator located between the water supply valve and the detergent case.

The drum washing machine performs a steam washing operation as follows. With laundry placed in the drum, a steam heater of the steam generator is operated to supply steam to the drum. During steam washing, the drive motor rotates the drum in the forward and reverse directions to agitate the laundry received therein. Steam generated by the steam heater sterilizes bacteria and fungus in the laundry.

Here, it should be noted that the aforementioned technique is described for understanding the related art of the invention and is not a well-known conventional technique in the art.

In a conventional steam generator, however, since a water supply time is not separately controlled, water drops are likely to be formed in the steam generator due to excessively high humidity in the case where the water supply time is extended despite the rapid generation of steam.

Therefore, there is a need to solve such problems of the washing machine.

SUMMARY OF THE INVENTION

An aspect of the invention is to provide a steam control device and method of a drum washing machine that can control the amount of water supplied to a steam generator by controlling a water supply valve depending on a water supply temperature.

In accordance with one aspect of the invention, a steam control device of a drum washing machine includes: a water supply valve adjusting an amount of water supplied to a steam generator; a temperature sensor detecting a temperature of water supplied to a steam generator; a memory storing a water supply time corresponding to a water supply temperature; and a microcontroller reading out the water supply time from the memory according to the water supply temperature input from the temperature sensor and opening the water supply valve for the water supply time.

The temperature sensor may be provided to a water supply part that supplies water to the steam generator.

The water supply time may be decreased as the water supply temperature increases.

The microcontroller may open the water supply valve for 5 to 7 seconds when the water supply temperature exceeds 70° C., for 8 to 10 seconds when the water supply temperature exceeds 55° C. but is less than or equal to 70° C., for 11 to 13 seconds when the water supply temperature exceeds 35° C. but is less than or equal to 55° C., and for 14 to 16 seconds when the water supply temperature is less than or equal to 35° C.

In accordance with another aspect of the invention, a steam control method of a drum washing machine includes: determining whether an instruction of course washing with steam is input; opening a water supply valve to supply water into a steam generator if the instruction of course washing is input; detecting a temperature of water supplied to the steam generator using a temperature sensor; and checking a water supply time corresponding to the detected water supply temperature and supplying water to the steam generator for the water supply time.

The detecting a temperature of water supplied to the steam generator may be performed after the water supply time exceeds a first preset period of time.

The first preset period of time may be 2~4 seconds.

The supplying of water to the steam generator may be repeated until a course time according to the instruction of course washing elapses.

The supplying of water to the steam generator may be stopped for a second preset period of time at each time when the water supply time elapses.

The second preset period of time may be 4~6 seconds.

In accordance with another aspect of the invention, a steam control method of a drum washing machine includes: opening a water supply valve to supply water into a steam generator; detecting a temperature of water supplied to the steam generator using a temperature sensor; and checking a water supply time corresponding to the detected water supply temperature and supplying water to the steam generator for the water supply time.

The temperature sensor may be provided to a water supply part that supplies water to the steam generator.

The water supply time may be decreased as the water supply temperature increases.

The water supply time may be 5 to 7 seconds when the water supply temperature exceeds 70° C., 8 to 10 seconds when the water supply temperature exceeds 55° C. but is less than or equal to 70° C., 11 to 13 seconds when the water supply temperature exceeds 35° C. but is less than or equal to 55° C., and 14 to 16 seconds when the water supply temperature is less than or equal to 35° C.

The detecting a temperature of water supplied to the steam generator may be performed after the water supply time exceeds a first preset period of time.

The first preset period of time may be 2~4 seconds.

BRIEF DESCRIPTION OF THE DRAWINGS

The above and other aspects, features and advantages of the invention will become apparent from the following detailed description in conjunction with the accompanying drawings, in which.

DETAILED DESCRIPTION OF THE EMBODIMENTS

Embodiments of the invention will now be described in detail with reference to the accompanying drawings.

Figure 1:
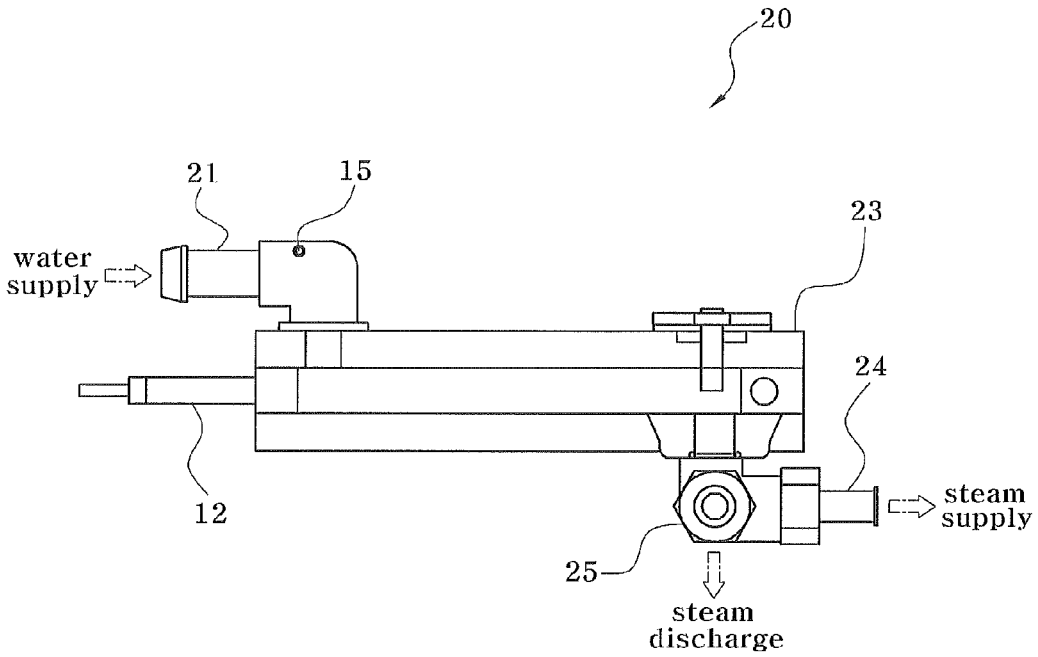
FIG. 1 is a side view of a steam generator in accordance with one embodiment of the present invention.
Figure 2:
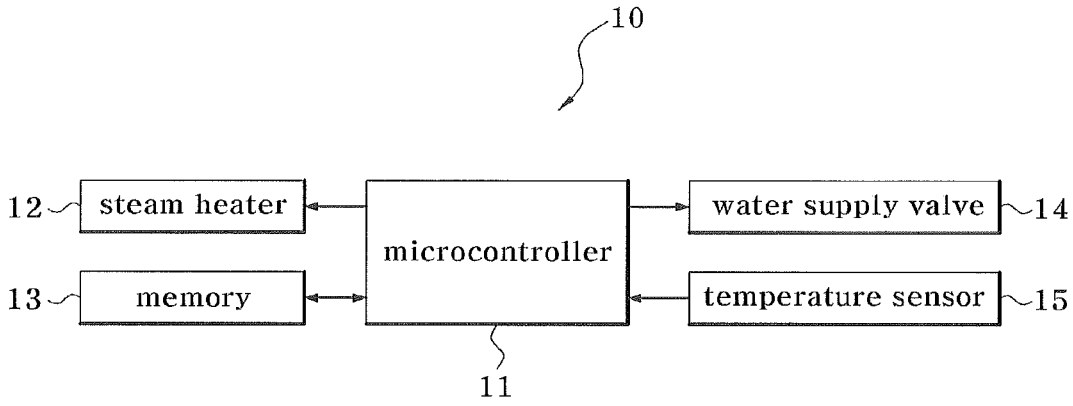
FIG. 2 is a block diagram of a steam control device in accordance with one embodiment of the present invention.

Referring to FIGS. 1 and 2, a steam generator 20 according to one embodiment includes: a water supply part 21 supplying water supplied through a water supply pipe to a heater case 23; the heater case 23 receiving the water and supplying steam generated by a steam heater 12 to a steam supply part 24; the steam heater 12 disposed inside the heater case 23 and heating the water inside the heater case 23 to generate steam; the steam supply part 24 connected at one side thereof to the heater case 23 and at the other side thereof to a steam supply pipe (not shown) to supply the steam from the heater case 23 to a drum of a washing machine; and a safety member 25 provided to the steam supply part 24 and selectively opened or closed depending on an inner pressure of the steam supply pipe with respect to an inner pressure of the heater case 23 to discharge the steam from the heater case 23 to an outside.

The steam generator 20 converts water supplied from the water supply part 21 into steam through the steam heater 12. The steam generated inside the heater case 23 is supplied to the drum through the steam supply part 24.

The safety member 25 is used in the case where steam is not normally supplied into the drum due to clogging of the steam supply pipe or the like. For example, when the inner pressure of the heater case 23 is excessively higher than that of the steam supply pipe, steam is discharged from the heater case 23 to the outside, thereby lowering the inner pressure of the steam case 23.

A temperature sensor 15 may be provided to the water supply part 21 of the steam generator 20 to detect the temperature of water supplied from the water supply part 21, that is, the water supply temperature, and send the detected water supply temperature to a microcontroller 11. Then, the microcontroller 11 may control opening or closing of the water supply valve 14 depending on the water supply temperature.

A water supply controller 10 of the drum washing machine includes the temperature sensor 15 that detects the temperature of supplied water; the water supply valve 14 opening or closing the water supply pipe to control the amount of water to be supplied to the water supply part 21; a memory 13 storing water supply times, which are preset for respective washing courses, such as steam washing, steam drying, and the like, and depend on the temperature of water supplied through the water supply part 21; and the microcontroller 11 operating the steam heater 12 corresponding to the washing courses. When receiving a detected water temperature sent from the temperature sensor 15, the microcontroller 11 reads out a water supply time corresponding to the detected water supply temperature from the memory 13 and opens the water supply valve 14 for the water supply time, thereby controlling the amount of water supplied into the heater case 23 through the water supply part 21. As such, the microcontroller 11 controls the water supply time depending on the water supply temperature, and Table 1 shows a water supply time corresponding to a water supply temperature according to one embodiment of the invention.

TABLE 1

| Water supply time depending on water supply temperature | |
|---|---|
| Water supply temperature (T) | Water supply time |
| T > 70° C. | 5~7 sec |
| 55° C. < T ≤ 70° C. | 8~10 sec |
| 35° C. < T ≤ 55° C. | 11~13 sec |
| T ≤ 35° C. | 14~16 sec |

In Table 1, the microcontroller 11 opens the water supply valve 14 for 5 to 7 seconds when the water supply temperature exceeds 70° C., for 8 to 10 seconds when the water supply temperature exceeds 55° C. but is less than or equal to 70° C., for 11 to 13 seconds when the water supply temperature exceeds 35° C. but is less than or equal to 55° C., and for 14 to 16 seconds when the water supply temperature is less than or equal to 35° C. Here, as the water supply temperature increases, the water supply time decreases to prevent generation of water drops.

Figure 3:
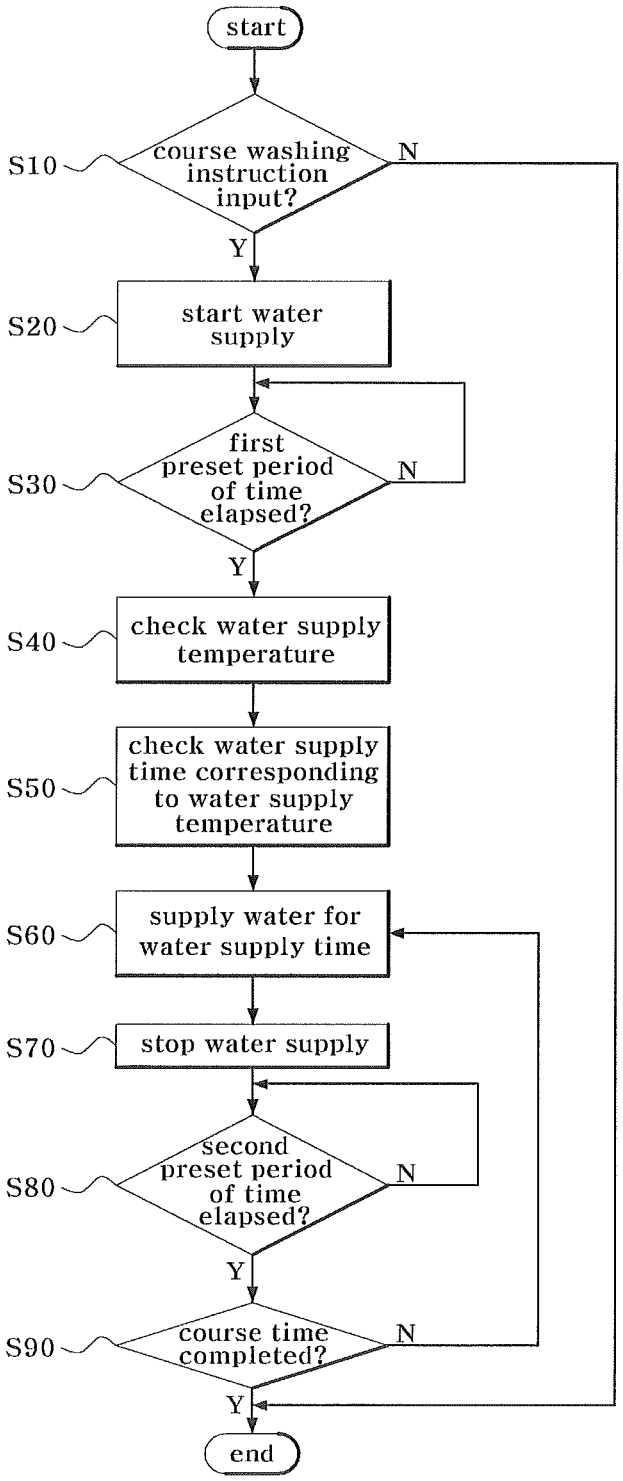
FIG. 3 is a flowchart of a steam control method in accordance with one embodiment of the present invention.

FIG. 3 is a flowchart of a steam control method in accordance with one embodiment of the invention. Next, a steam control method of a drum washing machine by operation of the microcontroller 11 will be described in detail with reference to FIG. 3.

In the steam control method according to this embodiment, in S10, it is determined whether an instruction of course washing with steam is input from a keypad (not shown) on which a variety of commands are input, and if the instruction of course washing with steam is input, the water supply valve 14 is opened to supply water to the water supply part 21 in S20.

Here, while supplying water by opening the water supply valve 14, it is checked whether a first preset period of time, for example, 2~4 seconds, has elapsed from a starting point of supplying the water, in S30. The first preset period of time is a period of time for measuring an accurate water supply temperature. At an initial stage of water supply, since water previously supplied and received for a previous washing operation is generally supplied again, it is difficult to accurately measure the water supply temperature. Thus, by measuring the water supply temperature after the first preset period of time from the starting time point of supplying the water, it is possible to accurately detect the current water supply temperature.

Then, if the first preset period of time has elapsed, the water supply temperature input from the temperature sensor 15 is checked in S40, and a water supply time corresponding to the water supply temperature stored in the memory 13 is checked in S50.

Here, the water supply time corresponding to the water supply temperature is shown in Table 1.

When the water supply time corresponding to the water supply temperature is checked, the water supply valve 14 is opened for the checked water supply time to supply water into the heater case 23 in S60.

When the water is completely supplied into the heater case 23 by opening the water supply valve 14 for the water supply time, the water supply valve 14 is closed to stop the water supply in S70. Here, the water supply to the heater case 23 is stopped for a second preset period of time, for example, 4~6 seconds, and it is determined whether the second preset period of time has elapsed in S80. The second preset period of time is a period of time for allowing laundry to be sufficiently soaked with wash water after stopping the water supply.

If the second preset period of time has elapsed, it is determined whether a preset course time for course washing, that is, a washing period of time preset for each of course washing operations, has elapsed in S90. If the preset course time has not elapsed, the water supply valve 14 is repetitiously opened and closed depending on the water supply temperature detected by the temperature sensor 15 until the preset course time elapses. If the course time has elapsed, the course washing is completed.

Figure 4:
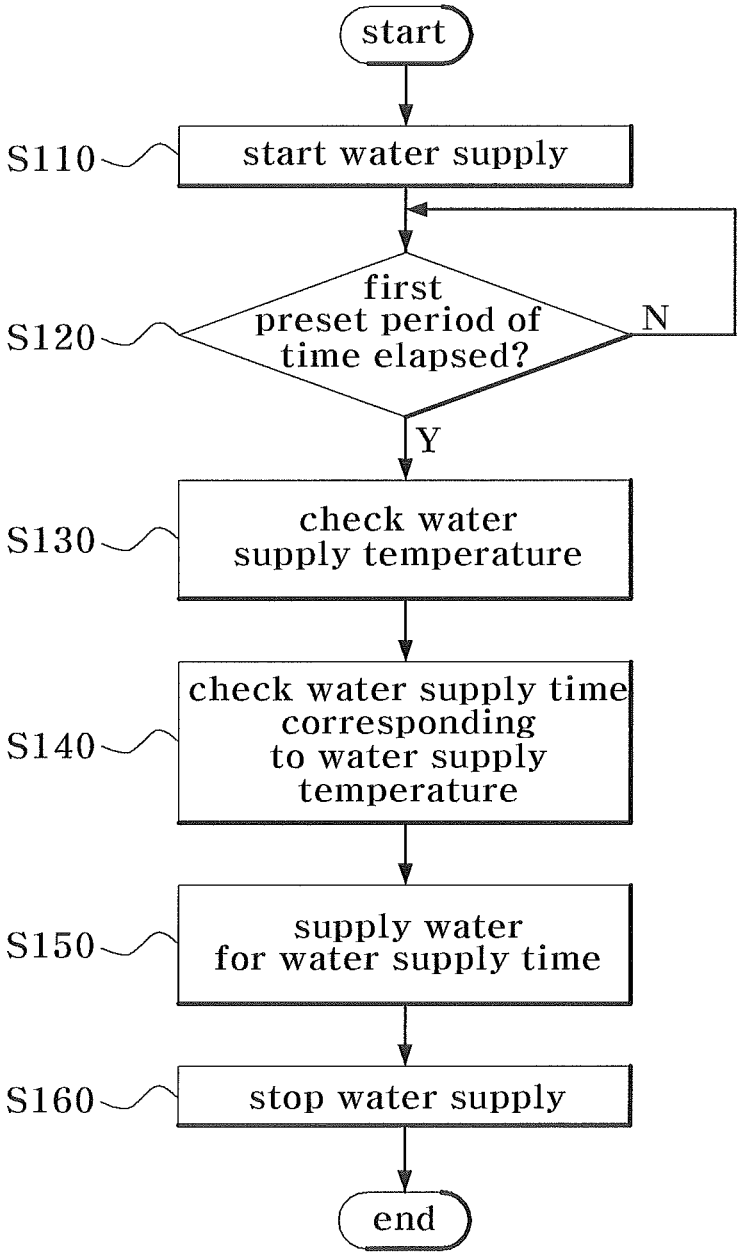
FIG. 4 is a flowchart of a steam control method in accordance with another embodiment of the present invention.

FIG. 4 is a flowchart of a steam control method in accordance with another embodiment of the invention. Referring to FIG. 4, in the steam control method according to this embodiment, when an instruction of course washing with steam is input from a keypad (not shown) on which a variety of commands are input, the water supply valve 14 is opened to supply water to the water supply part 21 in S110.

Here, while supplying water by opening the water supply valve 14, it is checked whether a first preset period of time, for example, 2~4 seconds, has elapsed from a starting point of supplying water, in S120. The first preset period of time is a period of time for measuring an accurate water supply temperature as described above.

Then, if the first preset period of time has elapsed, the water supply temperature input from the temperature sensor 15 is checked in S130, and a water supply time corresponding to the water supply temperature stored in the memory 13 is checked in S140. Here, the water supply time corresponding to the water supply temperature is shown in Table 1.

When the water supply time corresponding to the water supply temperature is checked, the water supply valve 14 is opened for the checked water supply time to supply water into the heater case 23 in S150. When the water is completely supplied into the heater case 23 by opening the water supply valve 14 for the water supply time, the water supply valve 14 is closed to stop the water supply in S160, thereby completing the water supply.

According to the embodiments, the temperature of water supplied to the steam generator is detected to control the water supply valve depending on the water supply temperature so that the amount of water supplied to the steam generator can be controlled.

Further, according to the embodiments, water drops are prevented from being discharged instead of steam from the steam generator, thereby improving steam washing efficiency.

Although some embodiments have been provided to illustrate the invention in conjunction with the drawings, it will be apparent to those skilled in the art that the embodiments are given by way of illustration only, and that various modifications and equivalent embodiments can be made without departing from the spirit and scope of the invention. The scope of the invention should be limited only by the accompanying claims.

What is claimed is:

1. A steam control method of a drum washing machine, comprising:

opening a water supply valve to supply water into a steam generator;

detecting a temperature of water supplied to the steam generator using a temperature sensor provided to a water supply part that supplies water to the steam generator; and supplying water to the steam generator for a water supply time, wherein the water supply time is pre-stored in a memory, the water supply time corresponding to the detected temperature of water.

2. The steam control method according to claim 1, wherein the water supply time is decreased as the water supply temperature increases.

3. The steam control method according to claim 2, wherein the water supply time is 5 to 7 seconds when the water supply temperature exceeds 70° C., 8 to 10 seconds when the water supply temperature exceeds 55° C. but is less than or equal to 70° C., 11 to 13 seconds when the water supply temperature exceeds 35° C. but is less than or equal to 55° C., and 14 to 16 seconds when the water supply temperature is less than or equal to 35° C.

4. The steam control method according to claim 1, wherein detecting the temperature of water supplied to the steam generator is performed after the water supply time exceeds a first preset period of time.

5. The steam control method according to claim 4, wherein the first preset period of time is 2~4 seconds.

* * * * *